US005874828A

United States Patent [19]

Lee

[11] Patent Number: 5,874,828

[45] Date of Patent: Feb. 23, 1999

[54] OFF-STATE VOLTAGE GENERATING CIRCUIT CAPABLE OF REGULATING THE MAGNITUDE OF THE OFF-STATE VOLTAGE

[75] Inventor: Gyu-Su Lee, Kyungki-do, Rep. of Korea

[73] Assignee: Samsung Electronics Co., Ltd., Suwon, Rep. of Korea

[21] Appl. No.: 766,790

[22] Filed: Dec. 13, 1996

[30] Foreign Application Priority Data

Dec. 13, 1995 [KR] Rep. of Korea ..... 1995-49315

[51] Int. Cl.[6] ..... G05F 1/40; G09G 3/36

[52] U.S. Cl. ..... 323/274; 345/100

[58] Field of Search ..... 323/274; 345/100; 349/25, 33, 34, 124

[56] References Cited

U.S. PATENT DOCUMENTS

| | | | |
|---|---|---|---|
| 4,716,359 | 12/1987 | Numata et al. | 323/274 |
| 5,402,142 | 3/1995 | Okada et al. | 345/100 |
| 5,574,474 | 11/1996 | Tamanoi | 345/100 |
| 5,621,439 | 4/1997 | Okada et al. | 345/100 |

*Primary Examiner*—Stuart N. Hecker
*Attorney, Agent, or Firm*—Marger, Johnson, McCollom & Stolowitz, PC

[57] ABSTRACT

An OFF-state voltage generating circuit regulates an OFF-state voltage level, for thin film transistors (TFT) in a liquid crystal display (LCD). A voltage generator receives a common voltage signal and an inverted common voltage signal and generates an OFF-state voltage to turn off the TFT of an LCD. A voltage regulator adjusts the level of the voltage from the voltage generator by varying the resistance of a variable resistor. A timing circuit keeps the voltage regulator from operating for a time during the initial ON-state of the power supply.

8 Claims, 2 Drawing Sheets

OFF-STATE VOLTAGE GENERATING CIRCUIT CAPABLE OF REGULATING THE MAGNITUDE OF THE OFF-STATE VOLTAGE

BACKGROUND OF THE INVENTION

1. Field of the Invention

The present invention relates to a circuit for generating an OFF-state voltage. More particularly, the present invention relates to an OFF-state voltage generating circuit of a thin film transistor liquid crystal display (hereinafter referred to as a TFT LCD), capable of regulating the magnitude of the OFF-state voltage.

2. Description of the Prior Art

A TFT LCD utilizes TFTs as an element for switching individual pixels on and off. The switching element has ON-state and OFF-state characteristics. The ON-state characteristic of the TFT is determined by the voltage transmission rate from a data line to a pixel when the TFT is turned on. The OFF-state characteristic is determined by the voltage storing rate in the pixel during an OFF-state. In order to obtain a good ON-state characteristic, the ON current should be large. In order to obtain a good OFF-state characteristic, the OFF current should be small.

FIG. 1 is a graph illustrating the voltage versus current characteristic of a TFT. The ON current is defined as the current when the magnitude of the applied voltage is larger than a critical voltage $V_{ON}$. The OFF current is defined as the current when the magnitude of the applied voltage is smaller than the voltage $V_{ON}$. As shown in FIG. 1, the magnitude of the ON current increases from $I_{ON}$ as the voltage increases. The curve for the OFF current has a minimum value $I_{OFF}$. The magnitude of the OFF current increases from $I_{OFF}$ as the OFF voltage increases from the value $V_{OFF}$. When the magnitude of the OFF voltage is in the range between $V_{OFF}$ and $V_{ON}$, the TFT has a non-optional shut-OFF characteristic.

FIG. 2 shows a conventional OFF-state voltage generating circuit. Diodes D3, D4, D5 and D6 are serially connected in a reverse biased direction to ground. One terminal of a capacitor C4 is connected to a node N1 between the diodes D4 and D5, and the other terminal receives an inverted common voltage $V_{COMB}$. One terminal of a capacitor C5 is connected to an anode of the diode D6 and the other terminal receives a common voltage $V_{COM}$.

If a power supply voltage is 5V and a threshold voltage of a diode is 0.75V, the common voltage $V_{COM}$ and the inverted common voltage $V_{COMB}$ alternate between 0V and 5V. An electrical potential at the second node N2, at which the diode D6 and the capacitor C5 are connected, alternates between −2V and −7V. As a result, the magnitude of the OFF-state voltage is fixed to two values.

The TFT characteristics are different from panel to panel. Thus, the magnitude of the OFF-state voltage requires adjustment to the TFT characteristics in order to obtain a good image quality. However, as described above, the conventional OFF-state voltage generating circuits cannot adjust the magnitude of the OFF state voltage.

SUMMARY OF THE INVENTION

Accordingly, the object of the present invention is to provide an OFF-state voltage generating circuit capable of regulating an OFF-state voltage level.

An OFF-state voltage generating circuit for a liquid crystal display comprises a voltage generator for generating a voltage required for turning off a transistor in a liquid crystal display. A voltage regulator regulates the magnitude of the voltage from the voltage generator.

The voltage regulator in one embodiment comprises a variable resistor that adjust the magnitude of the voltage from the voltage generator. The circuit also prevents the voltage regulator from operating for a given time during the initial ON-state of the power supply in order to reduce TFT shut-OFF time.

BRIEF DESCRIPTION OF THE DRAWINGS

The present invention will become more fully understood from the detailed description given herein below and the accompanying drawings which are given by way of illustration only, and thus do not limit the present invention.

DETAILED DESCRIPTION OF THE PREFERRED EMBODIMENTS

Figure 1:
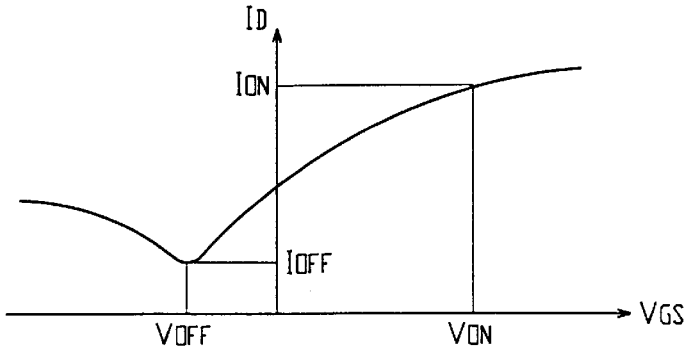
FIG.1 (Prior Art)
FIG. 1 is a graph illustrating a voltage versus current characteristic of a conventional TFT.
Figure 2:
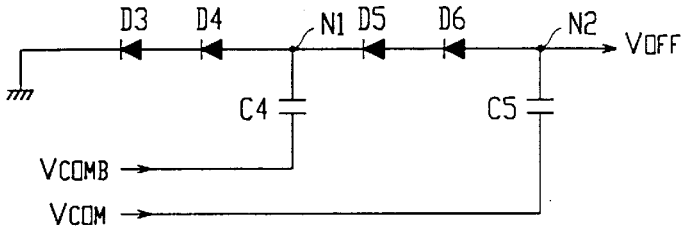
FIG.2 (Prior Art)
FIG. 2 is a circuit diagram of a conventional OFF-state voltage generating circuit.
Figure 3:
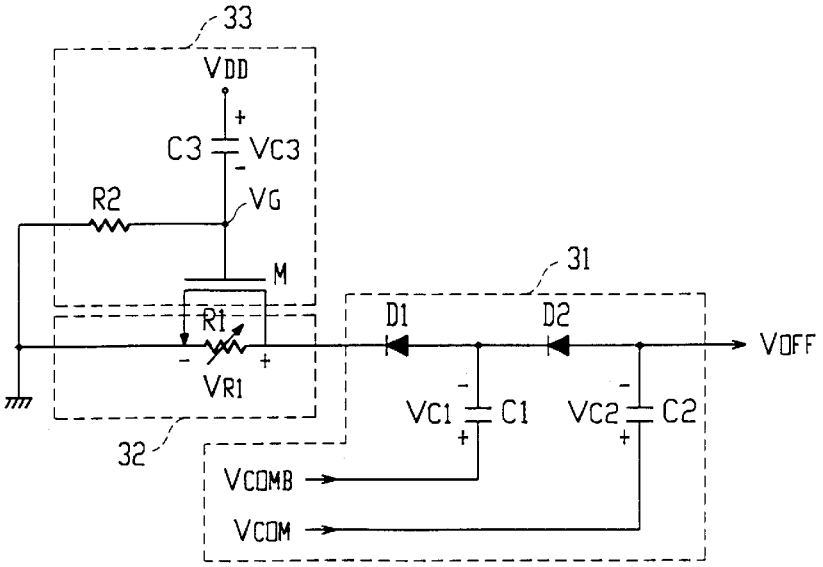
FIG. 3 is a circuit diagram illustrating an OFF-state voltage generating circuit according to the present invention.
Figure 4:
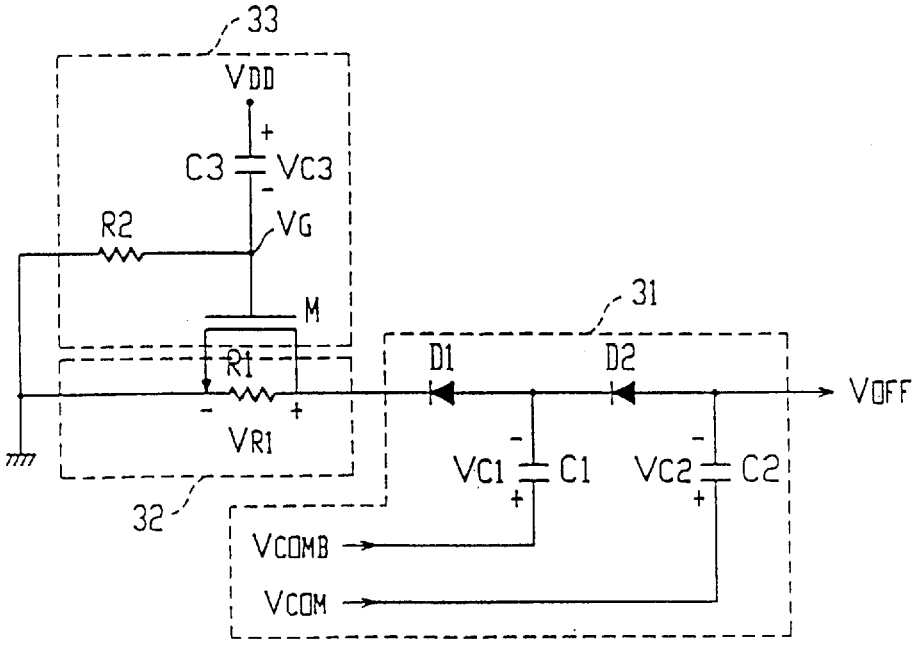
FIG. 4 is a circuit diagram illustrating an OFF-state voltage generating circuit according to the present invention with a fixed resistor.

An OFF-state voltage generator according to one embodiment of the present invention is shown in FIG. 3. An OFF-state voltage generator according to the embodiment has three parts. A voltage generator 31 is supplied with a common voltage $V_{COM}$ and an inverted common voltage $V_{COMB}$. A voltage regulator 32 is connected to the voltage generator 31 and ground, and a shut-down preventing circuit 33 is connected between the voltage regulator 32 and ground and is alternatively referred to as a timing circuit.

The voltage generator 31 consists of two diodes D1 and D2, and two capacitors C1 and C2. The two diodes D1 and D2 are serially connected in a reverse biased direction to the voltage regulator 32. A terminal of the diode D2 is used as an output terminal. A terminal of the capacitor Cl is connected to the node between the two diodes D1 and D2, while the other terminal is connected to the common voltage $V_{COM}$. One terminal of the capacitor C2 is connected to the anode of the diode D2 and the other terminal is connected to the inverted common voltage $V_{COMB}$.

The voltage generator 32 has a variable resistor R1. One terminal of the resistor R1 is connected to ground and the other terminal is connected to the cathode of the diode D1.

The shut-down preventing circuit 33 is comprised of a capacitor C3, an NMOS transistor M and a resistor R2. One terminal of the capacitor C3 is connected to a power supply $V_{DD}$, and the other terminal is connected to the gate of the transistor M. The source of the transistor M is connected to the grounded terminal of the resistor R1. The drain of the transistor M is connected to the other terminal of the resistor R1. One terminal of the resistor R2 is connected to the gate of the transistor M and the other terminal is connected to ground.

The voltage generator 31 generates a voltage for turning off a TFT. The voltage regulator 32 regulates the magnitude of the voltage from the voltage generator 31. The shut-down preventing circuit 33 disables operation of the voltage generator 31 for a short time when an initial voltage is applied from the power supply $V_{DD}$.

The common voltage $V_{COM}$ and the inverted common voltage $V_{COMB}$ charge the capacitors C1 and C2 respectively. The diodes D1 and D2 drop the voltages of the capacitors C1 and C2, respectively. The first capacitor C1 is charged with an inverted common voltage signal $V_{COMB}$ and then outputs the voltage after a reduction in the voltage by the diode D1 and the resistor R1. The second capacitor C2 is charged with a common voltage signal $V_{COM}$. and then outputs the OFF-state voltage after a reduction in the voltage by the diode D2. By adjusting the variable resistor R1 according to the characteristics of the panel, the magnitude of the OFF-state voltage $V_{OFF}$ from the voltage generator 31 is regulated.

The DC level is regulated without varying the amplitude of the OFF-state voltage $V_{OFF}$. The voltage $V_{C1}$ across the first capacitor C1 is variable without changing the voltage $V_{C2}$ across the second capacitor C2. The first capacitor C1 is charged only when the inverted common voltage signal $V_{COMB}$ is in a high state. The voltage $V_{C1}$ across the first capacitor C1 is calculated from the following Eq. 1.

$$V_{C1}=V_{COMB}(H)-V_{D1}-V_{R1}, \quad \text{(Eq. 1)}$$

$V_{COMB}$(H) is the inverted common voltage in a high state, $V_{D1}$ is the voltage across the diode D1, and $V_{R1}$ is the voltage across the resistor R1. When $V_{COMB}$(H) is equal to 5V and $V_{D1}$ is equal to 0.7V, the voltage $V_{C1}$ across the first capacitor C1 becomes $$V_{C1}=4.3-V_{R1} \quad \text{(Eq. 2)}$$

Accordingly, the voltage $V_{C1}$ across the first capacitor C1 can be adjusted by varying the voltage $V_{R1}$ across the variable resistor R1. As a result, by varying the voltage $V_{R1}$ across the variable resistor R1, the magnitude of the output voltage of the OFF-state voltage $V_{OFF}$ is adjustable. The variable resistor R1 in another embodiment is replaced with a fixed value resistor.

The variable resistor R1 has a value high enough in the initial power-on state to increase the transition time from a ground level to the required level. Thus, R1 could cause shut-down due to the disorder of the power sequence in a gate driver (not shown).

The shut-down preventing circuit 33 turns on the NMOS transistor for a brief time when power $V_{DD}$ turns on. This temporarily disables the variable transistor R1, shortening the transition time for the OFF-state voltage $V_{OFF}$.

In order to turn on the NMOS transistor M, the gate-to-source voltage should be higher than the threshold voltage $V_{TH}$ of the transistor M. The gate voltage $V_G$ of the NMOS transistor M is determined by the following equation, $$V_G=V_{DD}-V_{C3}, \quad \text{(Eq. 3)}$$

where $V_{C3}$ is a voltage across the third capacitor C3

During the initial ON-state of the power-supply $V_{DD}$, $V_{C3}$ is equal to zero since the third capacitor C3 is not charged. Therefore, the gate voltage $V_G$ has the same potential as the supply voltage $V_{DD}$, turning on the NMOS transistor M.

As time elapses, the voltage $V_{C3}$ across the third capacitor eventually equals to the voltage potential of the supply voltage $V_{DD}$. The gate voltage $V_G$ accordingly goes to zero and the NMOS transistor M turns off. Since the NMOS transistor remains turned-off, the OFF-state voltage $V_{OFF}$ varies in the voltage range determined by the resistance of the variable resistor R1. The transition time of the NMOS transistor M from the ON state to the OFF state is determined by the capacitance of the third capacitor C3 and the resistance of the resistor R2.

In summary, an OFF-state voltage generating circuit according to the present invention regulates an OFF-state voltage level while optimizing the operating conditions of a TFT. Thus, the image quality of the LCD is improved by adjusting the OFF-state voltage $V_{OFF}$.

What is claimed is:

1. An OFF-state voltage generating circuit for a liquid crystal display comprising:

a voltage generator for generating a voltage required for turning off a transistor of the liquid crystal display;

a voltage regulator for regulating the magnitude of the voltage from the voltage generator; and a timing circuit coupled between the voltage regulator and power supply, the timing circuit disabling the voltage regulator for a given time during an initial ON-state of the power supply.

2. The circuit of claim 1, wherein the voltage regulator comprises a variable resistor for adjusting the magnitude of the voltage from the voltage generator according to a selectable resistance of the variable resistor.

3. The circuit of claim 1, wherein the voltage generator comprises:

a first diode having an anode and a cathode, the cathode of the first diode connected to the voltage regulator;

a second diode having an anode and a cathode, the cathode of the second diode connected to the anode of the first diode;

a first capacitor having a first terminal for receiving an inverted common voltage signal and a second terminal connected between the first and the second diodes; and a second capacitor having a first terminal for receiving a common voltage signal and a second terminal connected to the anode of the second diode.

4. The circuit of claim 3, wherein the voltage regulator comprises a resistor having a constant resistance, the resistor has a first terminal, connected to the cathode of the first diode and a grounded second terminal.

5. The circuit of claim 3, wherein the voltage regulator comprises a variable resistor having a first terminal connected to the cathode of the first diode and a grounded second terminal.

6. The circuit of claim 5, wherein the timing circuit comprises:

a third capacitor having a first terminal connected to a power supply voltage and a second terminal;

an NMOS transistor M having a gate, a source and a drain, the gate connected to the second terminal of the third capacitor, the source connected to the second terminal of the variable resistor, and the drain connected to the first terminal of the variable resistor; and a resistor having a grounded first terminal and a second terminal connected between the third capacitor and the gate of the NMOS transistor, a given transition time for the NMOS transistor from the turn-on state to the turn-off state determined by the capacitance of the third capacitor and the resistance of the resistor.

7. A method for generating an OFF-state for a liquid crystal display comprising:

generating a voltage required for turning off the liquid crystal display;

regulating the voltage magnitude from the voltage generator according to given characteristics of the liquid crystal; and disabling voltage regulation for a given time period during an initial activation of a power supply ON-state.

8. A method according to claim 7 wherein regulating the voltage magnitude comprises varying the resistance of a variable resistor.

* * * * *